US010208758B2

(12) United States Patent
Chung et al.

(10) Patent No.: US 10,208,758 B2
(45) Date of Patent: Feb. 19, 2019

(54) INTERNAL HOT GAS BYPASS DEVICE COUPLED WITH INLET GUIDE VANE FOR CENTRIFUGAL COMPRESSOR

(71) Applicant: INDUSTRIAL TECHNOLOGY RESEARCH INSTITUTE, Hsin-Chu (TW)

(72) Inventors: Jenn-Chyi Chung, Changhua County (TW); Kun-Yi Liang, Hsinchu County (TW); Kuo-Shu Hung, Changhua County (TW); Chung-Che Liu, Hsinchu (TW); Hsu-Cheng Chiang, Hsinchu (TW)

(73) Assignee: INDUSTRIAL TECHNOLOGY RESEARCH INSTITUTE, Hsin-Chu (TW)

( * ) Notice: Subject to any disclaimer, the term of this patent is extended or adjusted under 35 U.S.C. 154(b) by 684 days.

(21) Appl. No.: 14/991,304

(22) Filed: Jan. 8, 2016

(65) Prior Publication Data

US 2017/0138366 A1 May 18, 2017

(30) Foreign Application Priority Data

Nov. 12, 2015 (TW) ..... 104137383 A

(51) Int. Cl.
*F04D 29/08* (2006.01)
*F04D 27/02* (2006.01)
(Continued)

(52) U.S. Cl.
CPC ..... *F04D 27/0215* (2013.01); *F04D 27/0246* (2013.01); *F04D 29/083* (2013.01);
(Continued)

(58) Field of Classification Search
CPC .. F04D 27/002; F04D 27/003; F04D 27/0315; F04D 27/0207; F04D 27/0246;
(Continued)

(56) References Cited

U.S. PATENT DOCUMENTS 4,836,746 A 6/1989 Owsianny et al.
5,618,160 A 4/1997 Harada et al.
(Continued)

FOREIGN PATENT DOCUMENTS

CN 2536821 Y 2/2003
CN 201330717 Y 10/2009
(Continued)

OTHER PUBLICATIONS

State Intellectual Property Office of the P. R. C, "Office Action", dated Nov. 9, 2017, China.
(Continued)

*Primary Examiner* — Jason Shanske
*Assistant Examiner* — Maxime Adjagbe
(74) *Attorney, Agent, or Firm* — Locke Lord LLP; Tim Tingkang Xia, Esq.

(57) ABSTRACT

An internal hot gas bypass device coupled with inlet guide vane for centrifugal compressor includes an inlet guide vane assembly, a driving motor assembly and a gas bypass valve assembly. The inlet guide vane assembly further includes a master vane, a plurality of slave vanes, a vane-front fixing ring, a vane-rear fixing ring, a vane-driving ring, a connecting pipe and a vane-opening indicating disk. The driving motor assembly further includes a motor, a driving unit and a motor fixing base. The gas bypass valve assembly further includes a valve, an external fixing-and-guiding ring, an internal fixing-and-guiding ring, a driven element, a spring, a sealing ring, a valve stud and a valve base. The driving motor assembly is connected with the driving unit and the
(Continued)

master vane of the inlet guide vane assembly via a connecting rod, and is further connected with the slave vanes of the gas bypass valve assembly.

11 Claims, 6 Drawing Sheets

(51) Int. Cl.
*F04D 29/28* (2006.01)
*F04D 29/46* (2006.01)
*F04D 29/42* (2006.01)

(52) U.S. Cl.
CPC ..... *F04D 29/284* (2013.01); *F04D 29/4213* (2013.01); *F04D 29/462* (2013.01); *F05D 2250/51* (2013.01)

(58) Field of Classification Search
CPC .. F04D 27/0253; F04D 29/462; F04D 29/541; F04D 29/083; F04D 29/284; F16K 17/36; F16K 31/04; F16K 31/008
USPC ..... 251/14
See application file for complete search history.

(56) References Cited

U.S. PATENT DOCUMENTS

| | | | | |
|---|---|---|---|---|
| 5,669,756 | A | 9/1997 | Brasz et al. | |
| 6,402,431 | B1 | 6/2002 | Nish | |
| 6,427,461 | B1 | 8/2002 | Whinery et al. | |
| 6,427,464 | B1 | 8/2002 | Beaverson et al. | |
| 6,994,518 | B2 * | 2/2006 | Simon | F01D 17/141 415/147 |
| 7,610,745 | B2 | 11/2009 | Fujii et al. | |
| 7,905,102 | B2 | 3/2011 | Bodell, II et al. | |
| 2003/0115870 | A1 | 6/2003 | Finger et al. | |
| 2010/0172745 | A1 | 7/2010 | Hodder | |
| 2015/0167481 | A1 | 6/2015 | Hung et al. | |

FOREIGN PATENT DOCUMENTS

| | | | |
|---|---|---|---|
| CN | 201851209 | U | 6/2011 |
| CN | 104428509 | A | 3/2015 |
| GB | 651417 | A | 4/1951 |
| GB | 839304 | A | 6/1960 |
| GB | 949031 | A | 2/1964 |
| JP | 05-157095 | | 6/1993 |
| JP | H08166109 | A | 6/1996 |
| JP | 2001193411 | A | 7/2001 |
| TW | 200634264 | | 10/2006 |
| TW | M445552 | U | 1/2013 |
| TW | M452139 | U | 5/2013 |
| TW | M475417 | | 4/2014 |
| TW | M481884 | U | 7/2014 |
| TW | M485205 | U | 9/2014 |

OTHER PUBLICATIONS

Intellectual Property Office, Ministry of Economic Affairs, R.O.C., "Notice of Allowance", dated Jun. 3, 2016, Taiwan.

L. Zhou et al., Experimental Investigation of the Unsteady Flow in a Centrifugal Compressor Stage, Experimental Techniques, 2012, vol. 36, Issue 5, pp. 20-29.

L. Zhou et al., Experimental Study on the Influence of Diffuser and Inlet Guide Vane for the Performance of Centrifugal Compressor, Experimental Techniques, 2008.

H. Jiang et al., IGV Wake Effect in Centrifugal Compressor, Experimental Techniques, 2011, pp. 41-52.

David Handel et al., Experimental Investigation of Transition and Separation Phenomena on an Inlet Guide Vane with Symmetric Profile at Different Stagger Angles and Reynolds Numbers, 15th International Symposium on Transport Phenomena and Dynamics of Rotating Machinery, 2014.

W. Zhang et al., The Effect of Half Vane Diffuser on the Noise Generated from a Centrifugal Fan, Experimental Techniques, 2012, pp. 5-13.

* cited by examiner

INTERNAL HOT GAS BYPASS DEVICE COUPLED WITH INLET GUIDE VANE FOR CENTRIFUGAL COMPRESSOR

CROSS REFERENCE TO RELATED APPLICATION

The present application is based on, and claims priority from, Taiwan (International) Application Serial Number 104137383, filed on Nov. 12, 2015, the disclosure of which is hereby incorporated by reference herein in its entirety.

TECHNICAL FIELD

The present disclosure relates to an internal hot gas bypass device coupled with an inlet guide vane for a centrifugal compressor, and more particularly to the internal hot gas bypass device coupled with an inlet guide vane for a centrifugal compressor that can help the centrifugal compressor to operate under an even lower loading condition without possible surging situations.

BACKGROUND

The centrifugal-type refrigeration equipment is known to be different in features with the volumetric compression-type refrigeration equipment. Currently, the control method upon capacity of a centrifugal water-chilling set is mainly to control the inlet guide vane (IGV) at the air inlet of the centrifugal compressor so as to regulate the loads and thereby to adjust the capacity of the water-chilling set. However, while the centrifugal water-chilling set is operated at a low loading condition or under a condition with an increasing pressure difference between the high and the low pressures, since the mass flow rate of the refrigerant cannot overcomes the pressure difference, the refrigerant flow is hard to reach the high-pressure end, and thus an unexpected stop in refrigerant flow is thus inevitable. Then, the gas at the high-pressure end would flow reversely back to the low-pressure end. As soon as the pressure at the low-pressure end is increased, namely while the pressure difference is reduced, the compressor vane may then resume its compression operation. At this time, the refrigerant flow backs to the normal flow, and the pressure difference rises again. In the case that the pressure difference rises to a value exceeding the compressible margin of the vane, the refrigerant gas at the high-pressure end would then flow reversely back to the low-pressure end again. Such a cycle repeating again and again is the so-called surging of the compressor.

The surging is specifically seen in the centrifugal machines. To avoid the surging, the conventional centrifugal-type water-chilling set usually bypass the high-pressure gas to the low-pressure end, such that the centrifugal-type water-chilling set can keep operated at the low loading condition without possible surging, and thus related damages to the compressor can be substantially reduced.

As described, the capacity adjustment of the centrifugal compressor is firstly to control the throttle percentage of the IGV while the load is reduced. As the minimum throttle percentage is already reached but the load keeps decreasing, the gas bypass is then opened so as to adjust the pressure and so as further to inhibit surging.

In the art, the IGV and the bypass structure in a centrifugal compressor are both isolated. In particular, the IGV is constructed inside the compressor, while the bypass structure is constructed to connect the exhaust pipe and the bypass pipe; in which the exhaust is to connect the outlet of the compressor and the condenser, and the bypass pipe is to connect the inlet of the compressor and the evaporator.

One of disadvantages in the aforesaid arrangement for separately constructing the IGV and the bypass structure is obvious the increased complexity of the piping for the compressor. Further, it is also required to establish individually a driving motor assembly and a controller to perform the driving and the control.

SUMMARY

Accordingly, in one embodiment of this disclosure, an internal hot gas bypass device coupled with an inlet guide vane for a centrifugal compressor is provided to comprises:

an inlet guide vane assembly, including a master vane, a plurality of slave vanes, a vane-front fixing ring, a vane-rear fixing ring, a vane-driving ring, a connecting pipe and a vane-opening indicating disk;

a driving motor assembly, including a motor, a driving unit and a motor fixing base; and a gas bypass valve assembly, including a valve, an external fixing-and-guiding ring, an internal fixing-and-guiding ring, a driven element, a spring, a sealing ring, a valve stud and a valve base;

wherein the driving motor assembly connects the driving unit and the master vane of the inlet guide vane assembly via a connecting rod, and the driving motor assembly connects the driven element of the gas bypass valve assembly.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
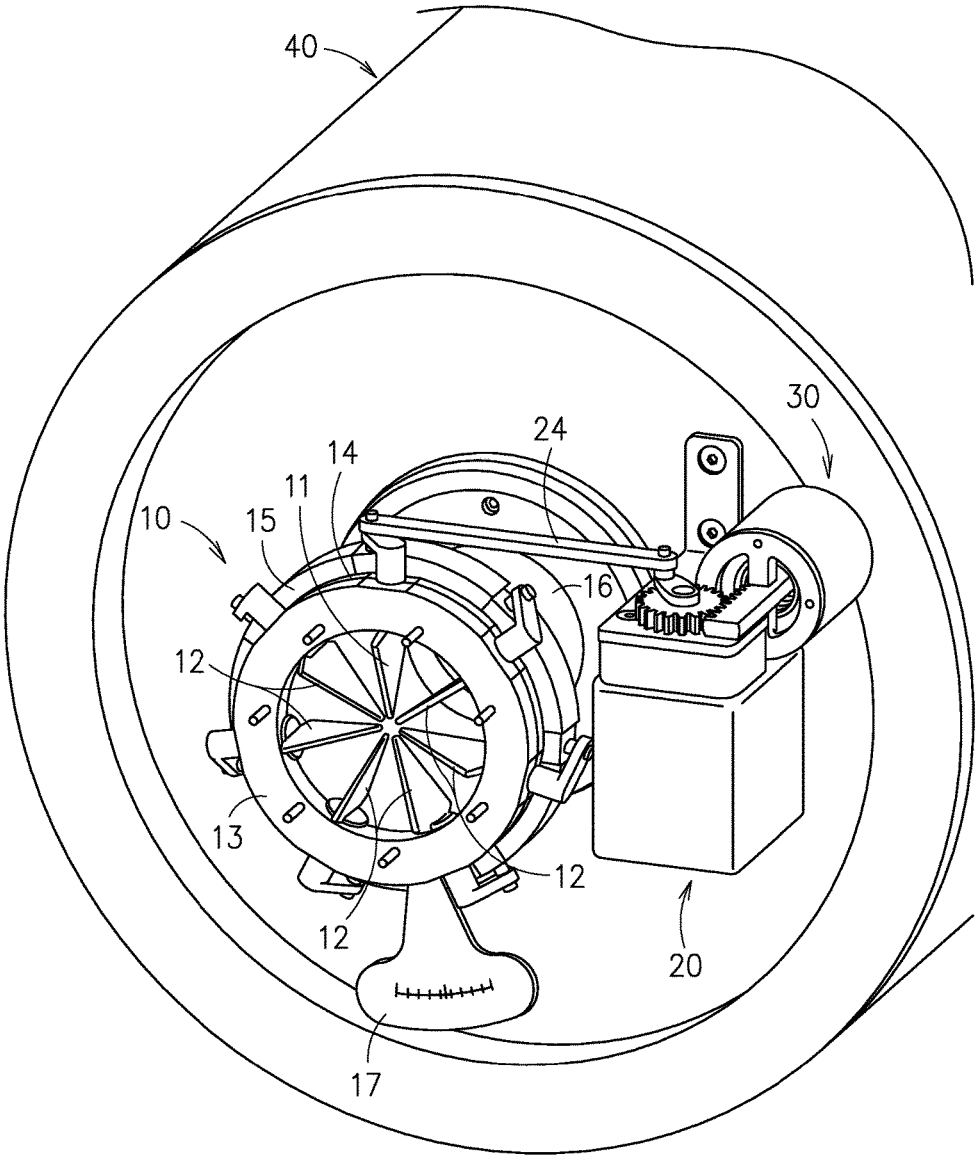
FIG. 1 is a schematic perspective view of an embodiment of the internal hot gas bypass device coupled with an inlet guide vane for a centrifugal compressor in accordance with this disclosure.
Figure 2:
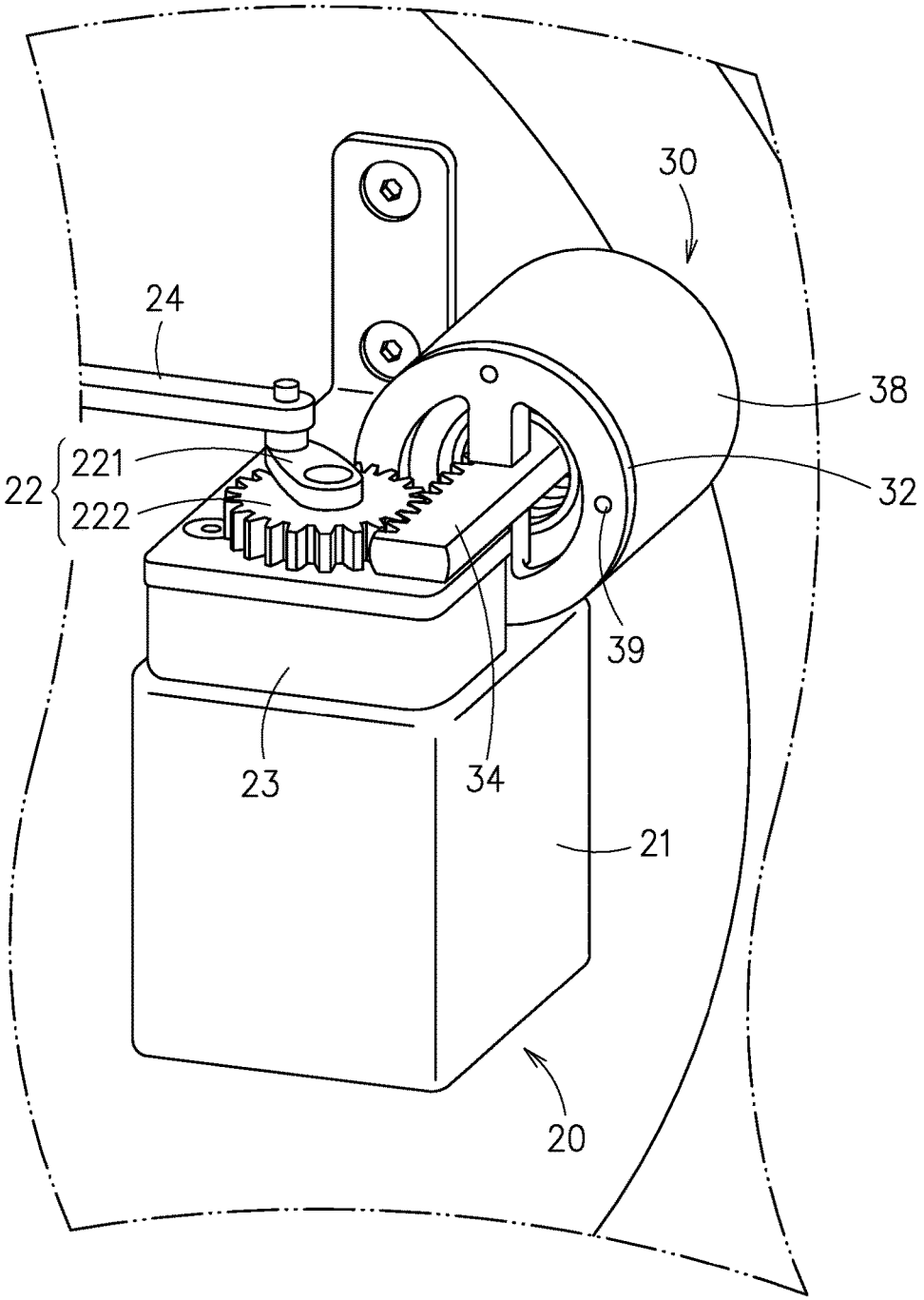
FIG. 2 is an enlarged view of the driving motor assembly 20 and the gas bypass valve assembly 30 of FIG. 1.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring now to FIG. 1 through FIG. 3B, a preferred embodiment of the internal hot gas bypass device coupled with an inlet guide vane for a centrifugal compressor in accordance with this disclosure includes an inlet guide vane assembly 10, a driving motor assembly 20 and a gas bypass valve assembly 30. All the inlet guide vane assembly 10, the driving motor assembly 20 and the gas bypass valve assembly 30 are constructed at one side of a compressor 40. In this embodiment, the compressor 40 is a centrifugal compressor.

The inlet guide vane assembly 10 is at least consisted of a master vane 11, a plurality of slave vanes 12, a vane-front fixing ring 13, a vane-rear fixing ring 14, a vane-driving ring 15, a connecting pipe 16 and a vane-opening indicating disk 17. It shall be noted that the connecting pipe 16 is to connect the inlet guide vane assembly 10 and the vane inlet of the compressor 40. At the connecting pipe 16, at least one hole (not shown in the figure) is included to allow the gas bypassed to the vacuum chamber 43 to enter the connecting pipe 16.

The driving motor assembly 20 is at least consisted of a motor 21, a driving unit 22 and a motor fixing base 23, in which the driving unit 22 further includes a driving link 221 and a driving spur gear 222. The driving motor assembly 20 implements a connecting rod 24 to connect the driving link 221 of the driving unit 22 and the master vane 11 of the inlet guide vane assembly 10 so as to enable the driving link 221 and the master vane 11 to rotate with the same angle. By having the master vane 11 to rotate the vane driving ring 15 and further the slave vanes 12 with the same angle, the master vane 11 and the slave vanes 12 can then to adjust their own throttle percentages ranged from 0° (full close)~90° (full open). The state shown in FIG. 1 is the full open state. After the master vane 11 and the slave vanes 12 are rotated synchronously 90°, then the state is a full close state.

Figure 3A:
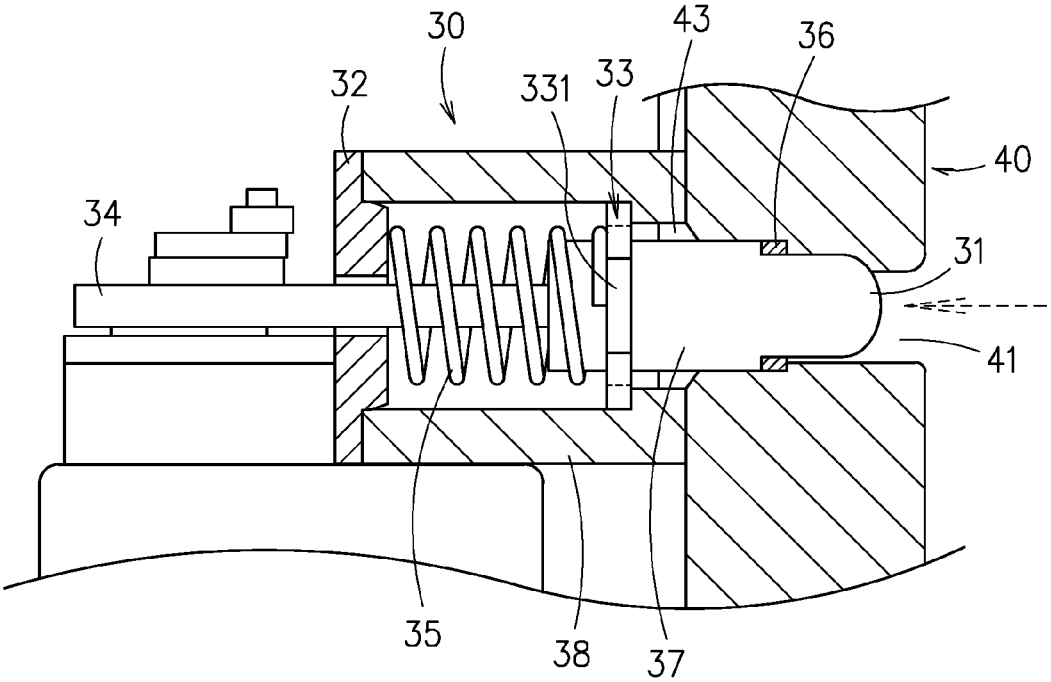
FIG. 3A is a schematic cross-sectional view of FIG. 2, in which the valve 31 is at a position of a close state.
Figure 3B:
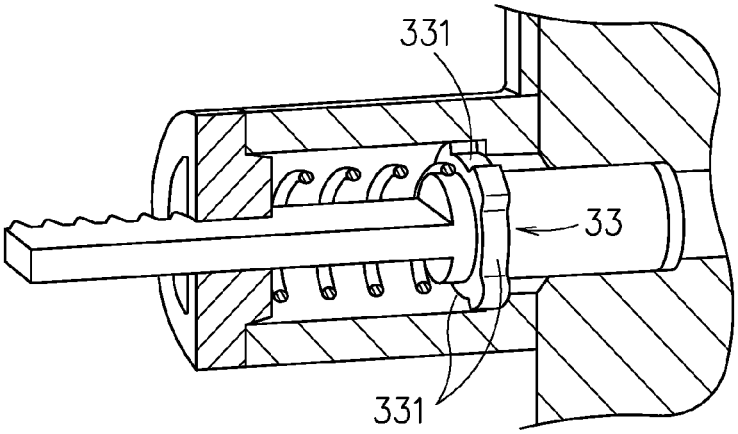
FIG. 3B is a schematic perspective cross-sectional view of a part of the gas bypass valve assembly of FIG. 3A.

The gas bypass valve assembly 30 is at least consisted of a valve 31, an external fixing-and-guiding ring 32, an internal fixing-and-guiding ring 33, a driving rack 34, a spring 35, a sealing ring 36, a valve stud 37 and a valve base 38. The external fixing-and-guiding ring 32 and the valve base 38 are tightly engaged by bolts 39. Referring now to FIG. 3A and FIG. 3B, the internal fixing-and-guiding ring 33 is surrounded by a plurality of inter-tooth rooms 331. The bypassed gas can enter a front chamber of the compressor 40 via the inter-tooth rooms 331, and then enter the vanes of the compressor 40 through the holes at the connecting pipe 16.

The driving motor assembly 20 implements a connecting rod 24 to connect the driving link 221 of the driving unit 22 and the master vane 11 of the inlet guide vane assembly 10. In addition, the driving motor assembly 20 implements the spur gear 222 to connect the driving rack 34 of the gas bypass valve assembly 30.

As described above, the driving motor assembly 20 has the driving spur gear 222 of the driving unit 22 to mesh the driving rack 34 so as to establish the connection with the gas bypass valve assembly 30 and to transform the rotational motion of the driving unit 22 into a linear motion occurring at the valve stud 37 and the valve 31 of the gas bypass valve assembly 30. By controlling the throttle percentage and corresponding areas preset for the bypass tunnels, flows of the bypassed gas can thus be controlled.

Referring now to FIG. 1 and FIG. 3A, when the throttle percentage of the master vane 11 and the slave vanes 12 of the inlet guide vane assembly 10 is 90°, then the assembly 10 is in the full open state. On the other hand, the valve 31 is at a position of being plugged in the outlet 41 of the compressor 40 so as to demonstrate a full close state. At this time, the gas at the outlet 41 of the compressor 40 cannot be bypassed to the front vacuum chamber 43.

Figure 4:
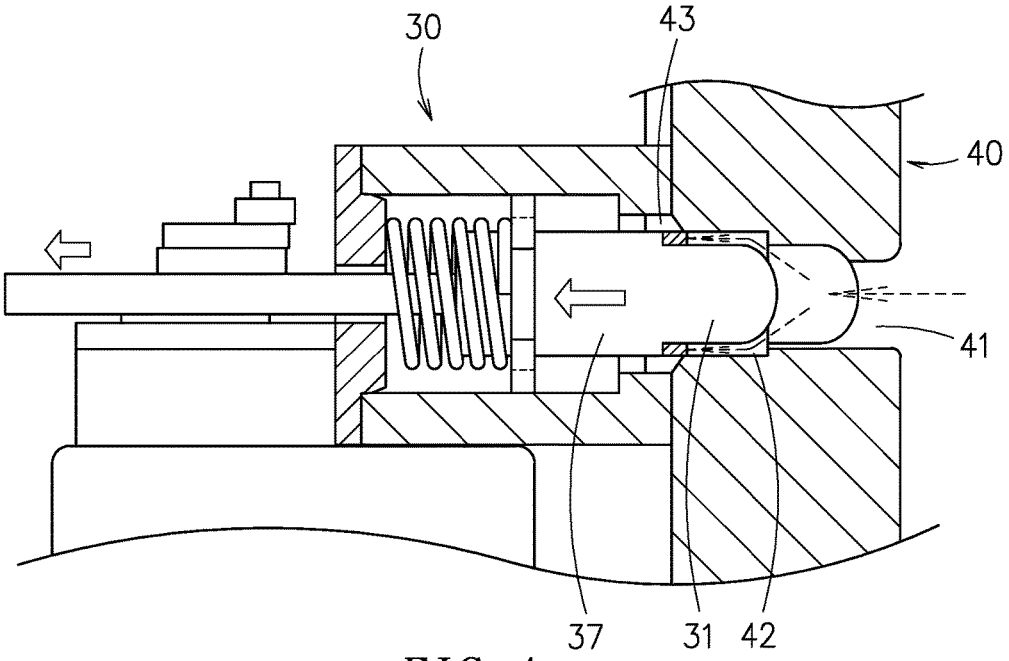
FIG. 4 is a schematic cross-sectional view of FIG. 2, in which the valve 31 is at another position of the close state.

Referring now to FIG. 1 and FIG. 4, when the throttle percentage of the master vane 11 and the slave vanes 12 of the inlet guide vane assembly 10 is at a predetermined angle, 15° for example, the valve 31 is now partially left the outlet 41 of the compressor 40. However, the displacement of the valve stud 37 and the valve 31 is yet to connect spatially the bypass tunnels 42 and the vacuum chamber 43, and thus the gas is still unable to be bypassed to the front vacuum chamber 43, as shown in the dashed lines. When the throttle percentage of the master vane 11 and the slave vanes 12 of the inlet guide vane assembly 10 is further decreased, the valve stud 37 and the valve 31 would displace further to a position that allow the bypass tunnels 42 to communicate spatially with the vacuum chamber 43.

Figure 5:
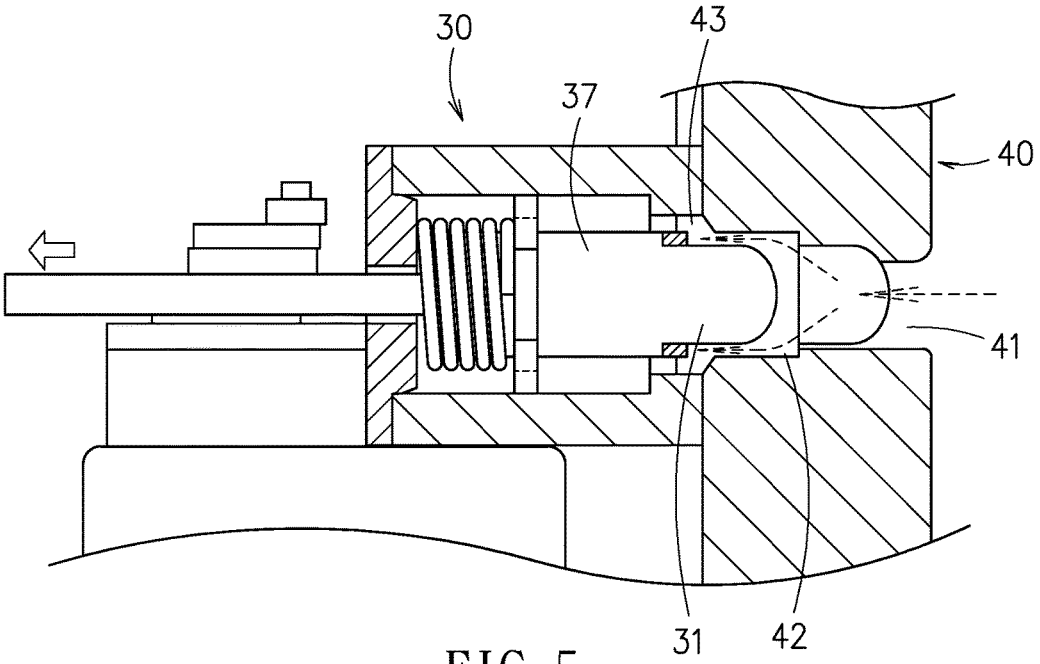
FIG. 5 is a schematic cross-sectional view of FIG. 2, in which the valve 31 is at a position of an open state.

Referring now to FIG. 1 and FIG. 5, when the throttle percentage of the master vane 11 and the slave vanes 12 of the inlet guide vane assembly 10 is 0°, then a full close state of the inlet guide vane assembly 10 is reached. Simultaneously, the gas bypass valve assembly 30 is in a full open state that the valve 31 is totally left the outlet 41 of the compressor 40, and thus the bypass tunnels 42 and the vacuum chamber 43 are spatially connected so as to fully open the gas bypass tunnels and enable the gas to bypass to the front vacuum chamber 43 of the compressor 40, as the paths shown by the dashed lines.

Figure 6:
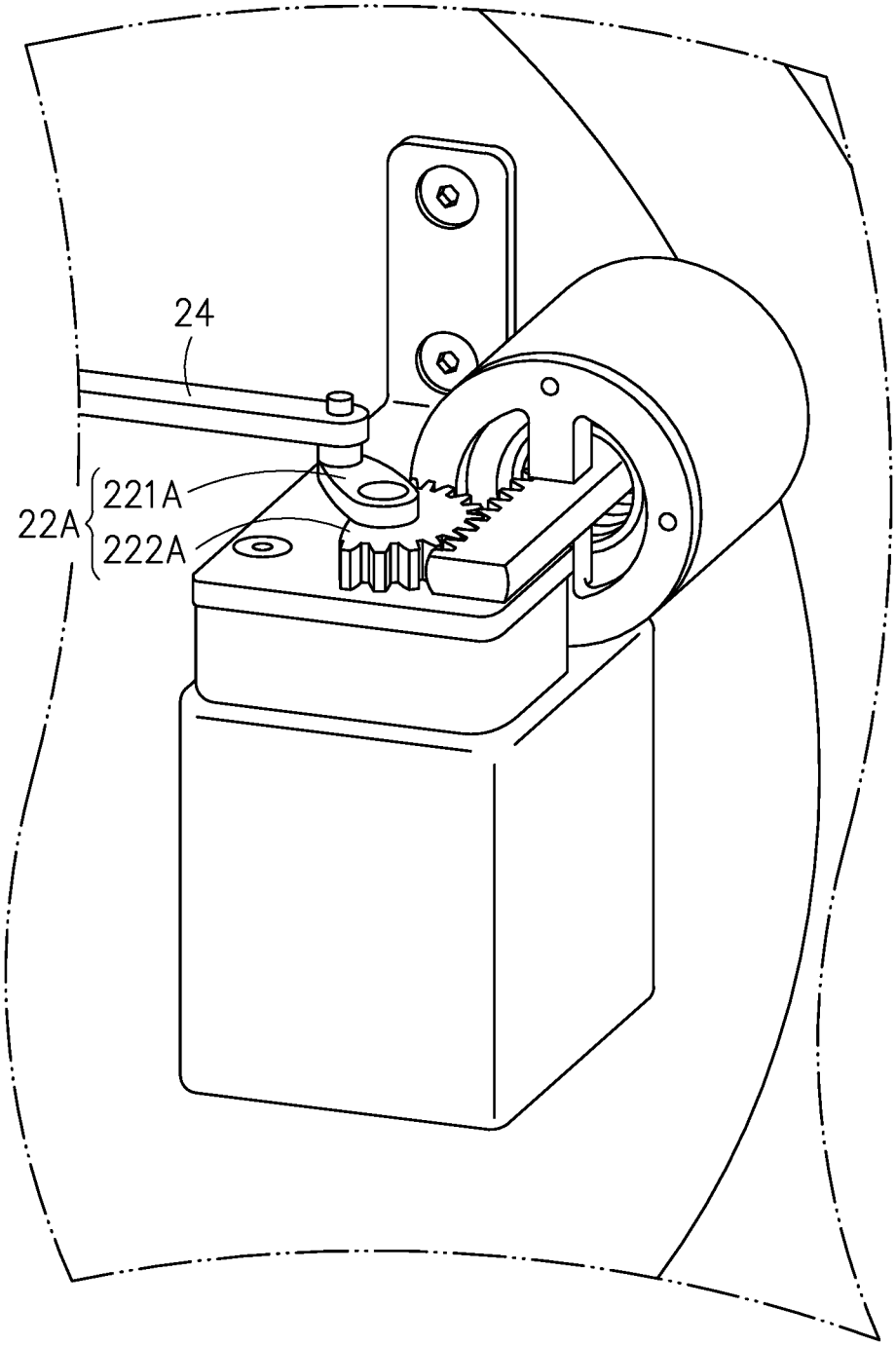
FIG. 6 is a schematic perspective view of another embodiment of the driving motor assembly in accordance with this disclosure.

Referring now to FIG. 6, another embodiment of the driving motor assembly in accordance with this disclosure is shown. The major difference between this embodiment and the previous embodiment shown in FIG. 1 is that, in this embodiment, the driving unit 22A adopts a geared cam 222A to replace the driving spur gear 222 of FIG. 1.

Figure 7:
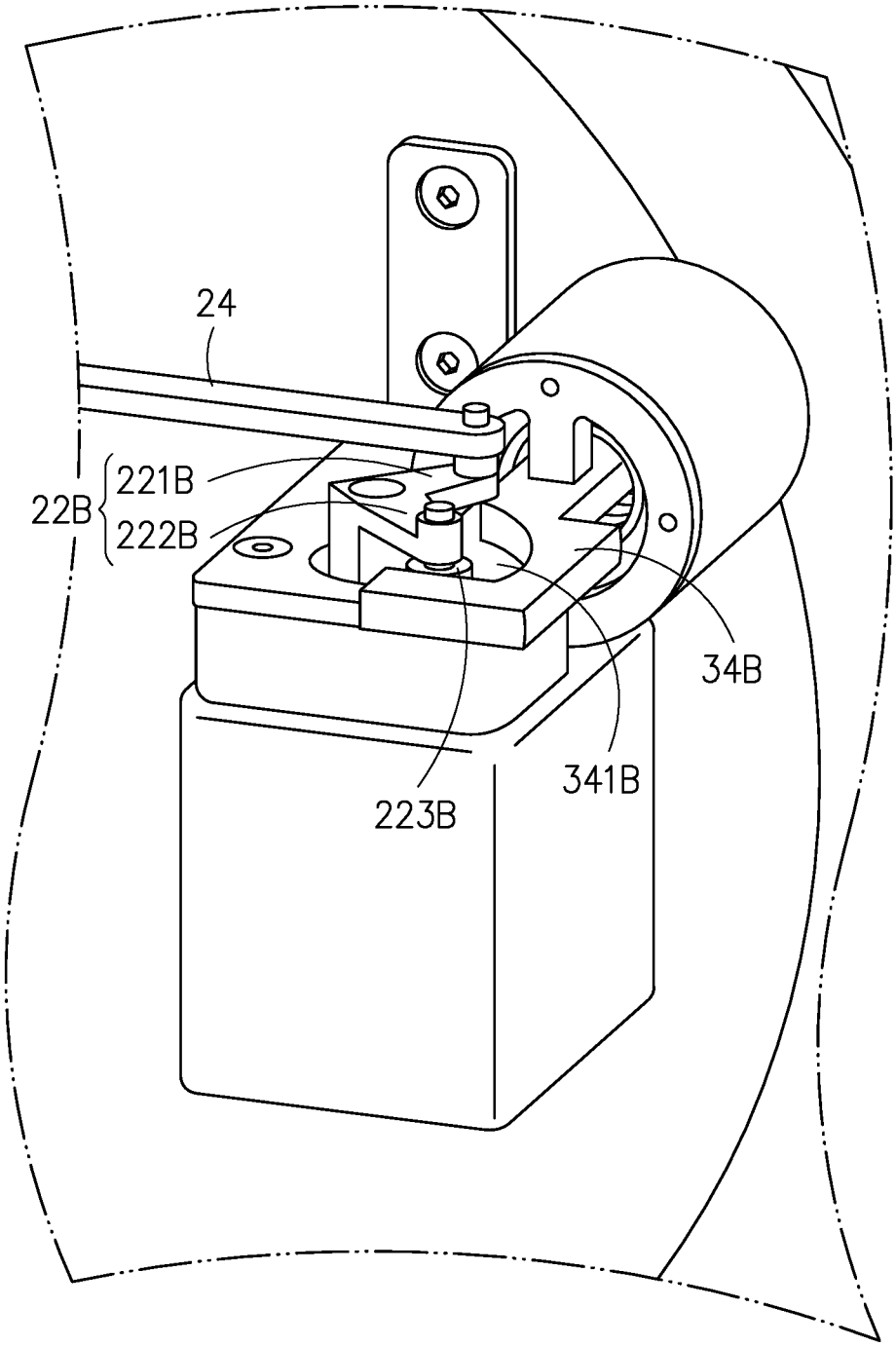
FIG. 7 is a schematic perspective view of a further embodiment of the driving motor assembly in accordance with this disclosure.

Referring now to FIG. 7, a further embodiment of the driving motor assembly in accordance with this disclosure is shown. The major difference between this embodiment and the previous embodiment shown in FIG. 1 is that, in this embodiment, the driving unit 22B is embodied as a duo-crank mechanism consisted of a first crank 221B and a second crank 222B. in addition, in this embodiment, the gas bypass valve assembly 30B implements a driving bar 34B to replace the driving rack 34 of FIG. 1. The first crank 221B implements a connecting rod 24 to connect with the master vane 11 of the inlet guide vane assembly 10, the second crank 222B is connected to the driving bar 34B of the gas bypass valve assembly 30, and the second crank 222B is connected to the driving bar 34 via an idle roller 223B. Further, the driving bar 34B includes an interference cut 341B to allow the roller 223B to be located inside the interference cut 341B and to rotate along the inner wall of the interference cut 341B, such that the rotational motion of the driving unit 22B can be transformed into the corresponding linear motion of the driving bar 34B.

In summary, in the internal hot gas bypass device coupled with an inlet guide vane for a centrifugal compressor provided by this disclosure, the inlet guide vane assembly and the internal gas bypass valve assembly can implement a driving unit to simultaneously couple the driving motor assembly, the driving rings of the inlet vane and the driving rack/bar of the gas bypass valve assembly. The crank of the driving unit is connected to the master vane of the inlet vane via the connecting rod. The master vane connects the other slave vanes via the driving ring. The driving motor assembly then implements the crank to enable the vanes of the inlet guide vane assembly to undergo an adjustment of the throttle percentage ranged from 0° (full close)~90° (full open), such that the flow and capacity of the centrifugal compressor can be adjusted. In addition, since the driving unit is connected simultaneously to the driving bar of the gas bypass valve, so when the throttle percentage of the inlet vane is adjusted to a minimum throttle percentage (15° for example), the gas bypass valve connected to the outlet of the compressor is opened to allow the bypassed gas to enter the vane, such that the volumetric capacity of the centrifugal compressor can be further reduced. Following are summarized features of this disclosure.

1. By applying mechanical coupling, a single driving motor assembly and a single controller are implemented to perform simultaneously the adjustment of both the throttle percentage of the gas inlet vane and that of the gas bypass valve.

2. By integrating the inlet vane and the gas bypass device into the same centrifugal compressor, then the centrifugal compressor can operate under an even lower load without possible surging to the compressor.

3. By applying the present disclosure, the centrifugal water-chilling set can obtain advantages in concise and simplified piping, reduced complexity of control and a lower cost.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. An internal hot gas bypass device coupled with an inlet guide vane for a centrifugal compressor, comprising:

an inlet guide vane assembly, including a master vane, a plurality of slave vanes, a vane-front fixing ring, a vane-rear fixing ring, a vane-driving ring, a connecting pipe and a vane-opening indicating disk;

a driving motor assembly, including a motor, a driving unit and a motor fixing base; and a gas bypass valve assembly, including a valve, an external fixing-and-guiding ring, an internal fixing-and-guiding ring, a driven element, a spring, a sealing ring, a valve stud and a valve base;

wherein the driving motor assembly connects the driving unit and the master vane of the inlet guide vane assembly via a connecting rod, and the driving motor assembly connects the driven element of the gas bypass valve assembly.

2. The internal hot gas bypass device coupled with an inlet guide vane for a centrifugal compressor of claim 1, wherein the driving unit is at least consisted of a driving link and a gear, and the driven element of the gas bypass valve assembly is a driving rack.

3. The internal hot gas bypass device coupled with an inlet guide vane for a centrifugal compressor of claim 2, wherein the driving motor assembly implements the connecting rod to connect the driving link of the driving unit and the master vane of the inlet guide vane assembly so as to have the driving link and the master vane able to undergo rotation with the same angle and further to have the master vane to drive the vane-driving ring and also the slave vanes to rotate synchronously.

4. The internal hot gas bypass device coupled with an inlet guide vane for a centrifugal compressor of claim 3, wherein the driving motor assembly implements the gear of the driving unit to connect the driving rack of the gas bypass valve so as thereby to transform rotational motion of the driving unit into linear motion at the valve stud and the valve of the gas bypass valve, such that control upon a predetermined throttle percentage and area of a bypass tunnel is able to control volumetric flow of bypassed gas.

5. The internal hot gas bypass device coupled with an inlet guide vane for a centrifugal compressor of claim 2, wherein the gear is one of a geared cam and a driving spur gear.

6. The internal hot gas bypass device coupled with an inlet guide vane for a centrifugal compressor of claim 2, wherein the external fixing-and-guiding ring and the valve base are tightly engaged by bolts.

7. The internal hot gas bypass device coupled with an inlet guide vane for a centrifugal compressor of claim 1, wherein the driving unit includes a first crank and a second crank, and the driven element of the gas bypass valve assembly is a driving bar.

8. The internal hot gas bypass device coupled with an inlet guide vane for a centrifugal compressor of claim 7, wherein the driving motor assembly implements the connecting rod to connect the first crank of the driving unit and the master vane of the inlet guide vane assembly so as to have the first crank and the master vane able to undergo rotation with the same angle and further to have the master vane to drive the vane-driving ring and also the slave vanes to rotate synchronously.

9. The internal hot gas bypass device coupled with an inlet guide vane for a centrifugal compressor of claim 7, wherein the driving motor assembly implements the second crank of the driving unit to connect the driving bar of the gas bypass valve so as thereby to transform rotational motion of the driving unit into linear motion at the valve stud and the valve of the gas bypass valve, such that control upon a predetermined throttle percentage and area of the bypass tunnel is able to control volumetric flow of bypassed gas.

10. The internal hot gas bypass device coupled with an inlet guide vane for a centrifugal compressor of claim 7, wherein the external fixing-and-guiding ring and the valve base are tightly engaged by bolts.

11. The internal hot gas bypass device coupled with an inlet guide vane for a centrifugal compressor of claim 7, wherein the second crank is connected to the driving bar via a roller, the driving bar further has an interference cut, and the roller is located inside the interference cut so as to rotate along an inner wall of the interference cut.

* * * * *